US007128137B2

(12) United States Patent
Dilley et al.

(10) Patent No.: US 7,128,137 B2
(45) Date of Patent: Oct. 31, 2006

(54) NESTED ATTACHMENT JUNCTION FOR HEAT EXCHANGER

(75) Inventors: Roland L. Dilley, Lomita, CA (US); Richard Paul Beldam, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 143 days.

(21) Appl. No.: 10/737,380

(22) Filed: Dec. 12, 2003

(65) Prior Publication Data

US 2005/0126768 A1 Jun. 16, 2005

(51) Int. Cl.
*F28F 9/02* (2006.01)
*F28F 1/00* (2006.01)

(52) U.S. Cl. ..... 165/158; 165/173

(58) Field of Classification Search ..... 165/158, 165/145, 157, 173, 175, 178, 76; 422/201
See application file for complete search history.

(56) References Cited

U.S. PATENT DOCUMENTS

| | | | | |
|---|---|---|---|---|
| 1,773,199 | A * | 8/1930 | Price | 165/82 |
| 2,313,315 | A | 3/1943 | Blair | |
| 2,389,175 | A | 11/1945 | Woods | |
| 2,783,980 | A * | 3/1957 | Christensen | 165/158 |
| 3,078,551 | A | 2/1963 | Patriarca et al. | |
| 3,111,167 | A * | 11/1963 | Young | 165/158 |
| 3,349,465 | A | 10/1967 | Pan et al. | |
| 3,610,330 | A * | 10/1971 | Nasser | 165/158 |
| 3,710,473 | A | 1/1973 | McElwain et al. | |
| 3,768,550 | A * | 10/1973 | Williamson et al. | 165/76 |
| 3,945,431 | A * | 3/1976 | Straub | 165/11.1 |
| 4,125,280 | A | 11/1978 | Kuzel | |
| 4,157,155 | A | 6/1979 | Smith | |
| 4,159,034 | A | 6/1979 | Bellovary et al. | |
| 4,192,374 | A | 3/1980 | Hayden et al. | |
| 4,272,006 | A | 6/1981 | Kao | |
| 4,421,160 | A * | 12/1983 | Stafford et al. | 165/76 |
| 4,519,445 | A | 5/1985 | Norris | |
| 4,877,083 | A | 10/1989 | Saperstein | |
| RE33,528 | E | 1/1991 | Doty | |
| 5,407,004 | A | 4/1995 | DeRisi et al. | |
| 5,823,251 | A * | 10/1998 | Romero | 165/158 |
| 6,206,086 | B1 * | 3/2001 | McKey | 165/76 |
| 6,269,870 | B1 | 8/2001 | Banzhaf et al. | |
| 6,427,768 | B1 | 8/2002 | Komoda et al. | |

FOREIGN PATENT DOCUMENTS

| | | |
|---|---|---|
| DE | 10233407 A1 | 7/2001 |
| EP | 0302618 | 8/1989 |
| JP | 01019295 A | 1/1989 |
| JP | 093/0996 | 2/1997 |
| JP | 2000241086 | 8/2000 |
| WO | WO/2005/083346 | 9/2005 |

* cited by examiner

*Primary Examiner*—Tho Duong
(74) *Attorney, Agent, or Firm*—Chris James

(57) ABSTRACT

Heat exchangers of this invention include a shell having an inner chamber defined by an inside wall surface, and having at least one opening adjacent an end of the shell. A tube bundle comprising a plurality of assembled together tubes are disposed within the inner chamber. A header plate is attached to the tubes and is positioned adjacent an end of the tube bundle. The header plate includes an outside diameter that fits within the shell inside wall surface to provide a nested attachment junction therebetween. The header plate and shell are fixedly connected to one another by use of a braze joint formed by the placement of brazing material between the interfacing header plate and the shell surface sections. A tank is attached to the shell adjacent the shell end.

15 Claims, 3 Drawing Sheets

NESTED ATTACHMENT JUNCTION FOR HEAT EXCHANGER

FIELD OF INVENTION

This invention relates generally to the field of heat exchangers and, more particularly, to heat exchangers that are specifically configured having one or more internal passages disposed within a surrounding body, and comprising a specifically configured attachment member for attaching the internal passages within the body.

BACKGROUND OF THE INVENTION

The present invention relates to heat exchangers that are generally configured comprising a number of internal fluid or gas passages disposed within a surrounding body. In an example embodiment, the internal passages are designed to accommodate passage of a particular fluid or gas in need of cooling, and the body is configured to accommodate passage of a particular cooling fluid or gas used to reduce the temperature of the fluid or gas in the internal passage by heat transfer through the structure of the internal passages. A specific example of such a heat exchanger is one referred to as a shell and tube exchanger, which can be used in such applications as exhaust gas cooling.

Referring to FIG. 1, a shell and tube heat exchanger 10 includes a tube bundle 12 formed from a plurality of individual tubes 14, i.e., internal passages, that are aligned together, positioned next to one another, and that have one or both openings at the tube ends 16 positioned adjacent one another. The tube bundle 12 is disposed within a surrounding shell 18.

The shell is configured having a inlet 20 and outlet 22 to facilitate the passage of a fluid or gas into and out of the shell. Referring now to FIG. 2, in a single-pass shell and tube heat exchanger, the tube bundle 12 is configured so that the tube ends 16 pass through respective ends 24 of the shell. In a dual or multi-pass shell and tube heat exchanger, the tube bundle is configured having one or more 180 degree bends at one of the tube ends to facilitate passage through the shell more than one time.

Referring back to FIG. 1, a tank or manifold 26 is attached to each end of the shell 18 and serves to direct the flow of fluid or gas into and out of the tube bundle. Referring to FIG. 2 again, a header or tube plate 28 is attached to the tube bundle adjacent one or more of the tube bundle ends 16 and forms a connection or attachment point between the tube bundle and a respective end of the shell. As best shown in FIG. 3, the header plate 28 connects the individual tubes 14 in the bundle together, connects the tube bundle to the shell 18, and provides a seal between the shell and the tube bundle so that fluid within the shell does not escape. The tank or manifold is typically attached by weld to the header plate to enable fluid tight transfer of fluid or gas from the tube bundle.

In a shell and tube heat exchanger configured for use in exhaust gas cooling, exhaust gas is passed through the tube bundle for cooling by use of a cooling medium such as water that is passed through the shell. Conventional shell and tube heat exchangers used in such applications are known to be susceptible to leakage due to the nature and geometry of the attachment made between the header plate and the shell. Such leakage is not desired as it can both reduce the operating efficiency of the heat exchanger and ultimately reduce the service life of the heat exchanger.

It is, therefore, desired that a heat exchanger be constructed in a manner that minimizes or eliminates the possibility of unwanted leakage between the tube bundle header plate and the shell. It is desired that such a heat exchanger be constructed in a manner that does not otherwise compromise the operation of the heat exchanger or adversely impact the manner in which the members forming the heat exchanger are attached together. It is desired that such heat exchangers be configured in a manner that does not adversely impact spatial concerns regarding mounting the same for use, thereby permitting easy retrofit use to replace conventional heat exchangers. It is further desired that such heat exchangers be constructed using materials and methods that are readily available to facilitate cost effective manufacturing and assembly of the same.

SUMMARY OF THE INVENTION

Heat exchangers, constructed in accordance with principles of this invention, comprise a shell having an inner chamber defined by an inside wall surface, and having at least one opening adjacent an end of the shell. A tube bundle comprising a plurality of assembled together tubes is disposed within the inner chamber. A header plate is attached to the tubes and is positioned adjacent an end of the tube bundle to connect the tube bundle to the shell.

The header plate includes an outside diameter that is configured to fit within the shell inside wall surface to provide a nested attachment junction therebetween. In an example embodiment, the shell inside wall surface includes a recessed section that extends axially a distance from an end of the shell, and the header plate outside diameter includes an axially projecting section that fits within the recessed section to form the nested attachment junction. The header plate may further comprise a lip that projects radially outwardly from the axially projecting section, and that is positioned adjacent the shell end. The header plate and shell are fixedly connected to one another by use of a braze joint formed by the placement of brazing material between the header plate axially projecting section and the shell recessed section.

A tank is attached to the shell adjacent the shell end, and the header plate lip is interposed between the shell and an end of the tank. In a preferred embodiment, at least one of the end of the tank and the end of the shell includes a chamfer along an outside surface. A welding material deposited between the tank and shell ends forms a permanent attachment therebetween.

Heat exchangers of this invention, comprising the nested attachment junction, provide a connection between the header plate and shell that is both structurally secure and that operates to minimize or eliminate the possibility of leakage from the heat exchanger, thereby operating to maximize heat exchanger efficiency and service life.

BRIEF DESCRIPTION OF THE DRAWINGS

The invention will be more clearly understood with reference to the following drawings wherein.

DETAILED DESCRIPTION OF THE INVENTION

The present invention relates to heat exchangers used for reducing the temperature of an entering gas or fluid stream. The particular application for the heat exchangers of the present invention is with vehicles and, more particularly, to cool an exhaust gas stream from an internal combustion engine. However, it will be readily understood by those skilled in the relevant technical field that the heat exchanger configurations of the present invention described herein can be used in a variety of different applications. Generally, the invention constructed in accordance with the principles of this invention, comprises a heat exchanger including header plate and shell sections that are specially designed to cooperate with one another to form a nested attachment junction providing a braze joint of sufficient length therebetween to resist and protect against unwanted leakage.

Figure 1:
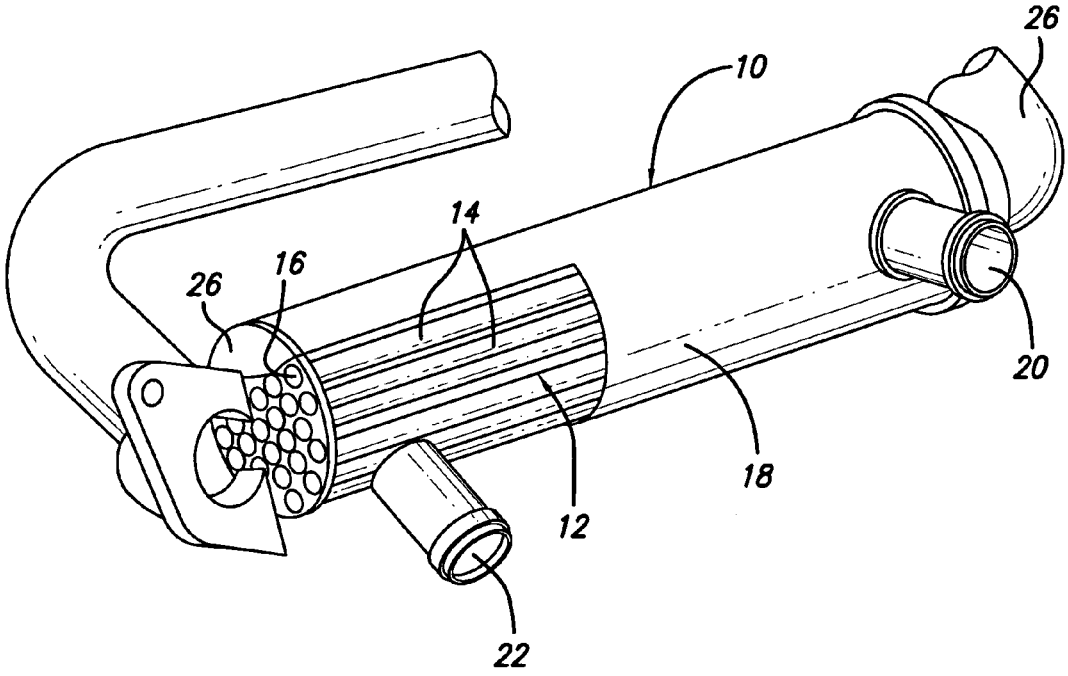
FIG. 1 PRIOR ART
FIG. 1 is a perspective view of a prior art shell and tube heat exchanger.
Figure 2:
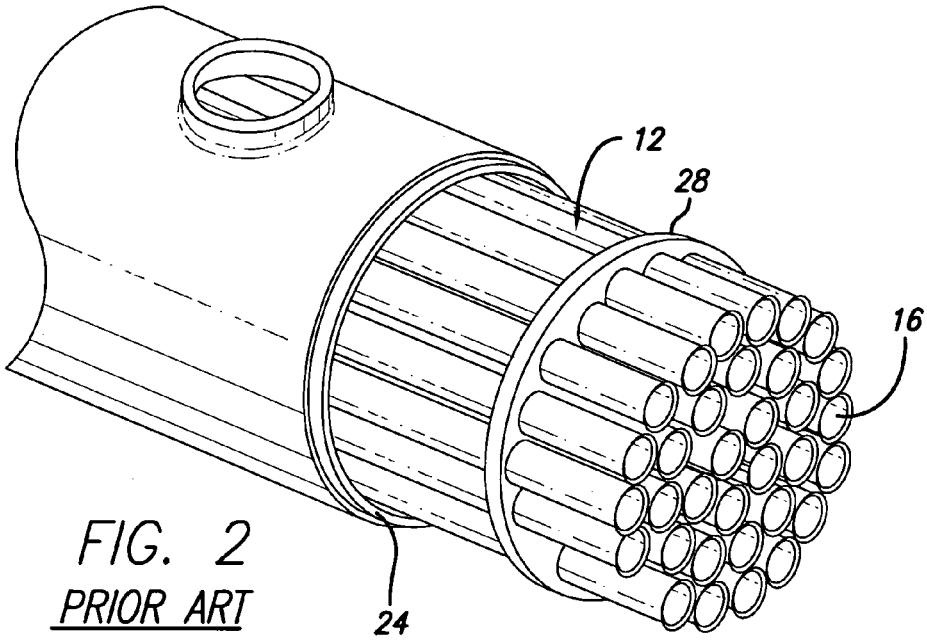
FIG. 2 PRIOR ART
FIG. 2 is a perspective view of the prior art heat exchanger of FIG. 1, illustrating placement of a tube bundle within a shell.
Figure 3:
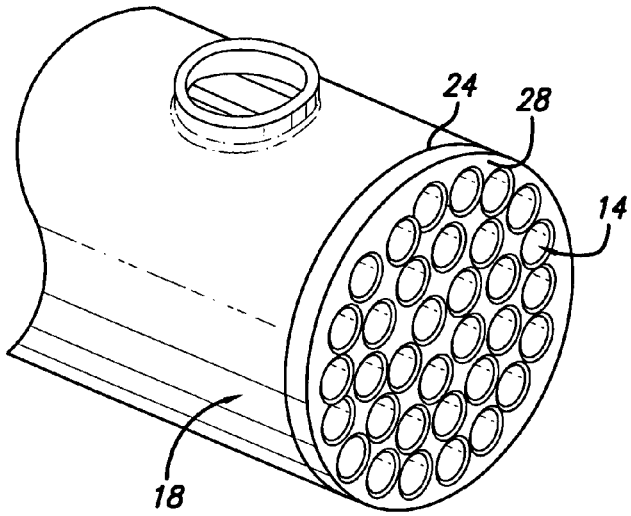
FIG. 3 PRIOR ART
FIG. 3 is a perspective view of the prior art heat exchanger of FIGS. 1 and 2, illustrating the tube bundle as attached to the shell.

Referring to FIG. 3, conventional shell and tube heat exchangers comprise a header plate 28 having a flat or planar butt joint interface with the shell end 24. This interface of surfaces is attached to one another by welding and, more specifically, by a butt weld. This construction is susceptible to leakage through braze voids that develop in these joints, particularly if tanks (shown in FIG. 1) are welded to the shell in the vicinity of these joints.

Figure 4:
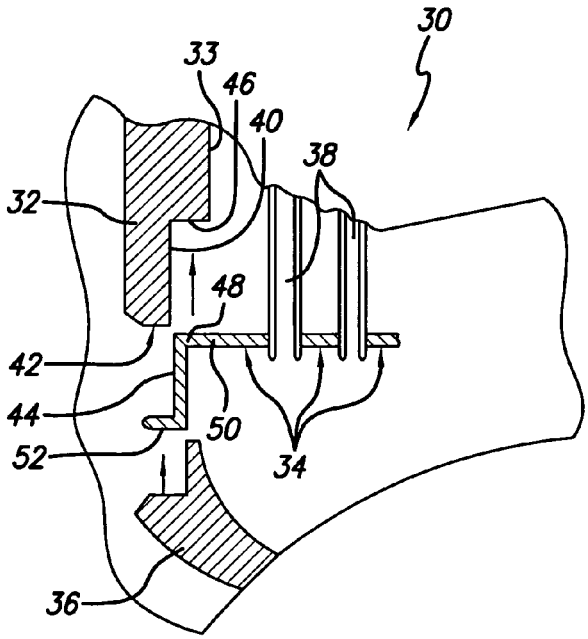
FIG. 4 is a cross-sectional view of a heat exchanger of this invention illustrating the shell, tube bundle, a header plate, and a tank in an unassembled state.

FIG. 4 illustrates a sectional view of a heat exchanger 30 of this invention taken at a junction between the shell 32, header plate 34, and tank 36. The heat exchanger 30 comprises a tube bundle, formed from a plurality of tubes 38 arranged together in the manner described above, that is disposed within the shell 32. The header plate 34 is positioned adjacent an end of the tube bundle, connects the tubes together, and as better described below provides a structure for connecting the tube bundle to the shell.

The shell 32 is configured having a recessed section 40 that extends circumferentially around an inside diameter of a shell inner wall surface 33 a determined radial depth. In an example embodiment, the recessed section may have a radial depth of from 2 to 5 mm. It is desired that the recessed section not extend too deep or too shallow because this recess creates a surface 46 that serves as an axial locator for the header plate when it is placed into the shell. If this radial depth is too small, it may not provide a sufficient land to stop the header plate from being pushed too far into the shell during assembly. If this radial depth is too large, the shell wall will be thinned excessively, which may leave it with insufficient strength in service.

The recessed section 40 extends axially along the inner wall surface a desired distance from a shell end 42. In an example embodiment, the recessed section may have an axial length of from 5 to 8 mm. It is desired that the recessed section not extend too little or too much because this section comprises the bulk of the braze joint between the shell and the header plate. If this axial length is too small, the braze joint may have insufficient strength. If this axial length is too large, it will unnecessarily restrict the effective tube bundle length for the given outer dimensions of the heat exchanger.

The header plate 34 is configured having an outside diameter that extends circumferentially therearound and that is configured to complement the surface features of the shell inside wall surface, e.g., the shell recessed section. In an example embodiment, the header plate 34 outside diameter comprises an axially projecting section 44 that is sized and shaped to fit against the shell recessed section 40 when the tube bundle is positioned within the shell. In such example embodiment, the axially projecting section 44 is sized having a diameter, as measured along an outside surface, that enables the axially projecting section 44 to fit within the recessed section without undue interference. The axially projecting section 44 is also sized having an axial length corresponding to that of the shell recessed section 40.

The shell recessed section 40 comprises a ridge 46 that extends radially inwardly therefrom, and that defines a transition between the recessed section and the remaining portion of the shell inner wall surface 33. The header plate 34 preferably includes a shoulder 48 that defines a transition between the radially directed body 50 of the header plate and the axially projecting section 44. The header plate shoulder and the shell recessed section ridge are sized and configured to provide a cooperative nesting fitment with one another when the tube bundle is placed within the shell.

In an example embodiment, the header plate 34 is also configured comprising a radially projecting lip 52 that extends outwardly from the axially projecting section 44, and that defines a peripheral portion of the header plate. The lip 52 is sized and shaped to fit against the shell end 42 when the tube bundle is disposed within the shell.

Figure 5:
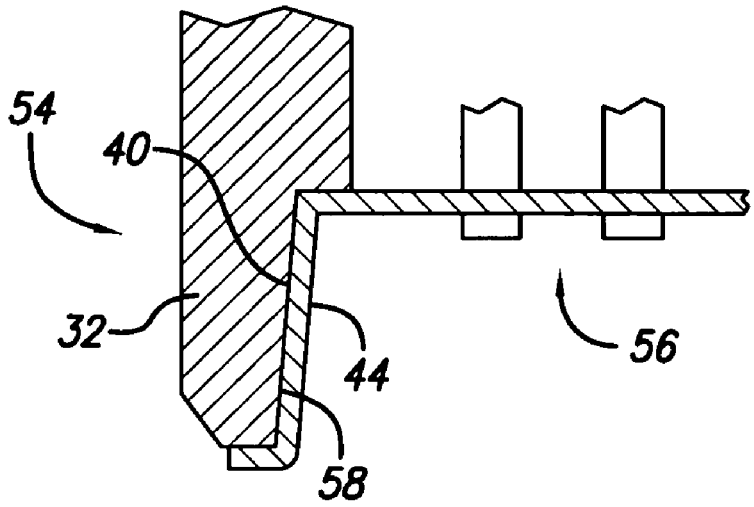
FIG. 5 is a cross-sectional view of the heat exchanger of FIG. 4 in an assembled state with the header plate brazed to the shell.

FIG. 5 illustrates the heat exchanger attachment junction 54, discussed above and illustrated in FIG. 4, after the tube bundle 56 has been positioned within the shell 32 and fixedly connected into place. In an example embodiment, once the tube bundle is positioned into the shell, such that the header plate axially projecting section 44 engages and cooperates with the shell recessed section 40, the header plate and shell are fixedly connected together by conventional means, such as by brazing 58 or the like. As illustrated, in a preferred embodiment, it is desired that the braze joint extend along as much of the interfacing shell and header plate surfaces as possible. In a most preferred embodiment, it is desired that the braze joint extend along a substantial entirety of the interfacing shell and header plate surfaces, including the surfaces between the header plate lip and the shell end, and the shell ridge and header plate shoulder.

If desired, the header plate can also be configured having a self-fixturing or registering means disposed along its outside diameter for locating the header plate in a particular position with respect to the shell during assembly and brazing.

Figure 6:
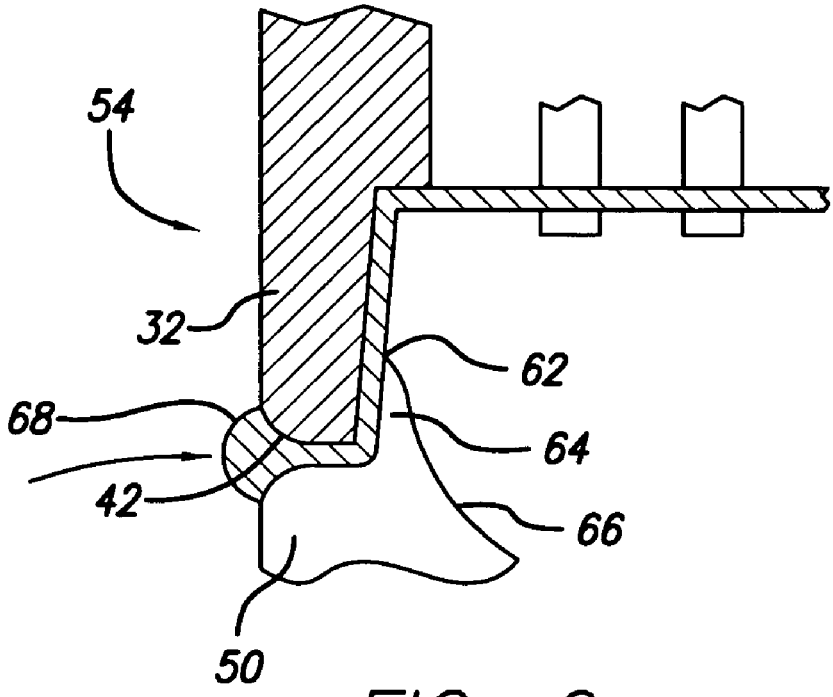
FIG. 6 is a cross-sectional view of the heat exchanger of FIG. 5 in an assembled state with the tank welded to the shell.

FIG. 6 illustrates the heat exchanger attachment junction 43 after a tank 60 has been attached to the shell 32. The tank is ideally configured having an end 62 that is configured and sized to complement and fit over the shell end 42 and a portion of the header plate that is positioned thereover. In a preferred embodiment, the tank end 62 is configured having an axially projecting ridge 64 positioned circumferentially around an inside wall surface 66 that extends a desired length. In an example, the axially projecting ridge 64 may have a length of from 2 to 5 mm. It is desired that the ridge not project too much or too little because this ridge serves to locate the tank radially, relative to the header plate and the shell. If the axial length of this ridge is too small, it may not positively locate the tank in the radial direction. If the axial length of this ridge is too large, it may contact and damage the main body of the header plate 34 or the tube ends 16.

The tank is fixedly connected to the shell, once the nested attachment junction is fixed by brazing, by conventional method such as welding and the like. In a preferred embodiment, the tank is welded 68 to the shell and both the tank and the shell each include outer edges that are chamfered to facilitate the welded attachment. The weld extends between the shell and tube, along an outer edge of the adjacent members, and between the shell and header plate, along an inner edge of the adjacent member.

A key feature of heat exchangers of this invention is the formation of a nested attachment junction between the header plate and the shell. Upon brazing, the nested attachment junction operates to provide a braze joint between the header plate and tube having improved leak fastness when compared to the butt attachment junction of conventional heat exchangers. The header plate and shell are intentionally configured in the manner described above to provide a nested attachment junction of desired length, contributing to the leak fastness of the resulting braze joint, even after the tank is welded into place.

Although the invention as described and illustrated above has been presented in the context of a shell and tube-type heat exchanger, it is to be understood that nesting attachment junctions of this invention can be used with other types of heat exchangers that make use of similar or related connecting members, and that such embodiments are intended to be within the scope of this invention. Additionally, while a particular embodiment of the heat exchanger nesting attachment junction of this invention has been described an illustrated, it is to be understood that modifications and variations of this configuration may be apparent to those skilled in the art, and that such modifications and variations are intended to be within the scope of this invention.

What is claimed is:

1. A heat exchanger comprising:

a shell having an inner chamber defined by an inside wall surface, and having at least one opening adjacent an end of the shell, the inside wall surface including a recessed section extending axially a distance from an end of the shell, the recessed section comprises a ridge that extends radially inwardly therefrom, and that defines a transition between the recessed section and the remaining portion of the shell inner wall surface;

a tube bundle disposed within the inner chamber and comprising a plurality of tubes arranged together;

a header plate attached to the tubes and positioned adjacent an end of the tube bundle, the header plate including an outside diameter having an axially projecting section that extends therefrom, and a radially projecting lip that extends from an end of the axially projecting section, wherein the axially projecting section and radially projecting lip are integral with the header plate, and wherein the outside diameter further comprises a shoulder at the transition with the axially projecting section, and wherein the shoulder is positioned against the ridge to provide a nested attachment junction between the header plate and the shell.

2. The heat exchanger as recited in claim 1 further comprising brazing material interposed between the shell recessed section and the header plate.

3. The heat exchanger as recited in claim 1 further comprising a tank attached to the shell adjacent the shell end, wherein the header plate lip is interposed between the shell and an end of the tank.

4. The heat exchanger as recited in claim 3 wherein at least one of the end of the tank and the end of the shell includes a chamfer along an outside surface, and welding material is interposed between the tank and shell ends.

5. The heat exchanger as recited in claim 3 wherein the tank includes a recessed wall section adjacent the tank end, and wherein at least a portion of the header plate axially projecting section is disposed therein when the tank is attached to the shell.

6. The heat exchanger as recited in claim 1 further comprising a tank connected to the shell end, wherein the tank comprises an inside wall surface having a recessed section positioned adjacent an end of the tank that is sized to fit within the recessed section of the shell.

7. A shell and tube heat exchanger comprising:

a shell having an inner chamber defined by an inside wall surface and having at least one opening adjacent an end of the shell, the shell having a recessed section extending circumferentially around the inside wall surface and extending axially a distance from the end, the recessed section comprises a ridge that extends radially inwardly therefrom, and that defines a transition between the recessed section and the remaining portion of the shell inner wall surface;

a tube bundle disposed within the inner chamber and comprising a plurality of tubes arranged together;

a header plate attached to the tubes and positioned adjacent an end of the tube bundle, the header plate including;

an outside diameter having an axially projecting section that fits within the recessed section, wherein the header plate is positioned against the shell ridge to provide a nested attachment junction therebetween; and a lip projecting radially outwardly away from the axially projecting section, wherein the axially projecting section and lip are both integral with the header plate; and brazing material interposed between the axially projecting section and the recessed section.

8. The heat exchanger as recited in claim 7 wherein the lip is positioned adjacent the shell end.

9. The heat exchanger as recited in claim 8 further comprising a tank attached to the shell adjacent the shell end, wherein the header plate lip is interposed between the shell and an end of the tank.

10. The heat exchanger as recited in claim 9 wherein at least one of the end of the tank and the end of the shell includes a chamfer along an outside surface, and welding material is interposed between the tank and shell ends.

11. The heat exchanger as recited in claim 7 further comprising a tank connected to the shell end, wherein the tank comprises an inside wall surface having a recessed section positioned adjacent an end of the tank that is sized to fit within the recessed section of the shell.

12. The heat exchange as recited in claim 9 wherein the tank includes a recessed wall section adjacent the tank end, and wherein at least a portion of the header plate axially projecting section is disposed therein when the tank is attached to the shell.

13. A method for making a heat exchanger comprising the steps of:

inserting a tube bundle comprising a plurality of combined tubes into an internal chamber of a surrounding shell, the shell including an open end, and the tubes being connected to a header plate;

forming a nested attachment junction between the shell and the header plate, wherein the inside wall surface of the shell includes a recessed section adjacent to the shell open end, the recessed section comprises a ridge that extends radially inwardly therefrom, and that defines a transition between the recessed section and the remaining portion of the shell inner wall surface, wherein the header plate includes an axially projecting section extending from the outside diameter and a lip extending radially outwardly from the axially projecting section, the outside diameter comprising a shoulder at the transition to the axially projecting section, wherein the nested attachment junction is formed between the header plate shoulder and shell ridge, and wherein the lip is positioned along the shell open end; and forming a braze joint in the nested attachment junction by depositing brazing material between the header plate and the shell.

14. The method as recited in claim 13 further comprising the step of attaching a tank to the shell adjacent the shell end, wherein the header plate lip is interposed between the shell and an end of the tank.

15. The method as recited in claim 14 wherein at least one of the end of the tank and the end of the shell includes a chamfer along an outside surface, and the step of attaching the tank further comprises depositing welding material between the tank and shell ends.

* * * * *